US011072894B2

(12) United States Patent
Hirman et al.

(10) Patent No.: US 11,072,894 B2
(45) Date of Patent: Jul. 27, 2021

(54) MILLING ASSEMBLY MATERIAL FLOW CONTROL SYSTEM

(71) Applicant: Caterpillar Paving Products Inc., Brooklyn Park, MN (US)

(72) Inventors: Colton J. Hirman, Maple Grove, MN (US); Jeffrey W. Hoyle, Rogers, MN (US); Dustin W. Sondreal, Hanover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 1 day.

(21) Appl. No.: 16/513,520

(22) Filed: Jul. 16, 2019

(65) Prior Publication Data

US 2021/0017720 A1 Jan. 21, 2021

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01); *E01C 2301/50* (2013.01)

(58) Field of Classification Search
CPC ..... B65G 31/04; E01C 23/088; E01C 23/127; E01C 2301/50
USPC ..... 198/640, 642
See application file for complete search history.

(56) References Cited

U.S. PATENT DOCUMENTS

| | | | | |
|---|---|---|---|---|
| 5,695,256 | A * | 12/1997 | Kishimoto | E01C 23/088 299/39.2 |
| 9,512,718 | B2 | 12/2016 | Von Schoenebeck et al. | |
| 10,227,740 | B2 | 3/2019 | Verhaelen et al. | |
| 2004/0148823 | A1* | 8/2004 | Schenk | E02F 7/06 37/466 |
| 2004/0211092 | A1* | 10/2004 | Barnes | E02F 7/02 37/142.5 |
| 2012/0187745 | A1* | 7/2012 | Erdmann | E01C 23/088 299/39.2 |
| 2019/0135553 | A1* | 5/2019 | Hirman | E01C 23/127 |

FOREIGN PATENT DOCUMENTS

| | | |
|---|---|---|
| DE | 2852218 | 12/1987 |
| DE | 3303751 | 7/1994 |
| KR | 101363049 | 2/2014 |

* cited by examiner

*Primary Examiner* — Janine M Kreck
*Assistant Examiner* — Michael A Goodwin
(74) *Attorney, Agent, or Firm* — Schwegman, Lundberg & Woessner

(57) ABSTRACT

A milling assembly includes a drum housing including a discharge port; a cutting rotor located within the drum housing; and a flow director positioned within the drum housing proximate the discharge port and configured to direct a flow of material removed by the cutting rotor towards a first stage conveyor positioned near the discharge port.

20 Claims, 5 Drawing Sheets

MILLING ASSEMBLY MATERIAL FLOW CONTROL SYSTEM

TECHNICAL FIELD

The present disclosure generally relates to a milling assembly. More particularly, the present disclosure relates to a milling assembly of a cold planer.

BACKGROUND

Cold planers are powered machines used to remove at least part of a surface of a paved area such as a road, bridge, or parking lot. Typically, cold planers include a frame, a power source, a milling assembly positioned below the frame, and a conveyor system. The milling assembly includes a cutting rotor having numerous cutting bits disposed thereon. As power from the power source is transferred to the milling assembly, this power is further transferred to the cutting rotor, thereby rotating the cutting rotor about its axis. As the rotor rotates, its cutting bits engage the hardened asphalt, concrete or other materials of an existing surface of a paved area, thereby removing layers of these existing structures. The spinning action of the cutting bits transfers these removed layers to the conveyor system which transports the removed material to a separate powered machine such as a haul truck for removal from a work site.

However, especially for deeper cuts, material removed by the cutting rotor can end up having almost a vertical flow. This is inefficient since the material may not reach the conveyor.

U.S. Pat. No. 9,512,718 describes a milling machine where the housing includes an inspection opening to allow a partial flow of milled material to pass through the inspection opening.

SUMMARY

In an example according to this disclosure, a milling assembly can include a drum housing including a discharge port; a cutting rotor located within the drum housing; and a flow director positioned within the drum housing proximate the discharge port and configured to direct a flow of material removed by the cutting rotor towards a first stage conveyor positioned near the discharge port.

In one example, a cold planer can include a frame; a first stage conveyor coupled to the frame; a milling assembly including a drum housing, the drum housing including a discharge port, wherein the first stage conveyor is positioned near the discharge port so as to receive material through the discharge port; and a cutting rotor located within the drum housing; wherein, the drum housing includes a flow director to direct a flow of material removed by the cutting rotor towards the first stage conveyor.

In one example, a method of controlling material flow in a cold planer can include digging up material from a roadbed using a cutting rotor, the cutting rotor located within a drum housing having a discharge port; and redirecting a flow of the material removed by the cutting rotor towards a first stage conveyor positioned near the discharge port.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
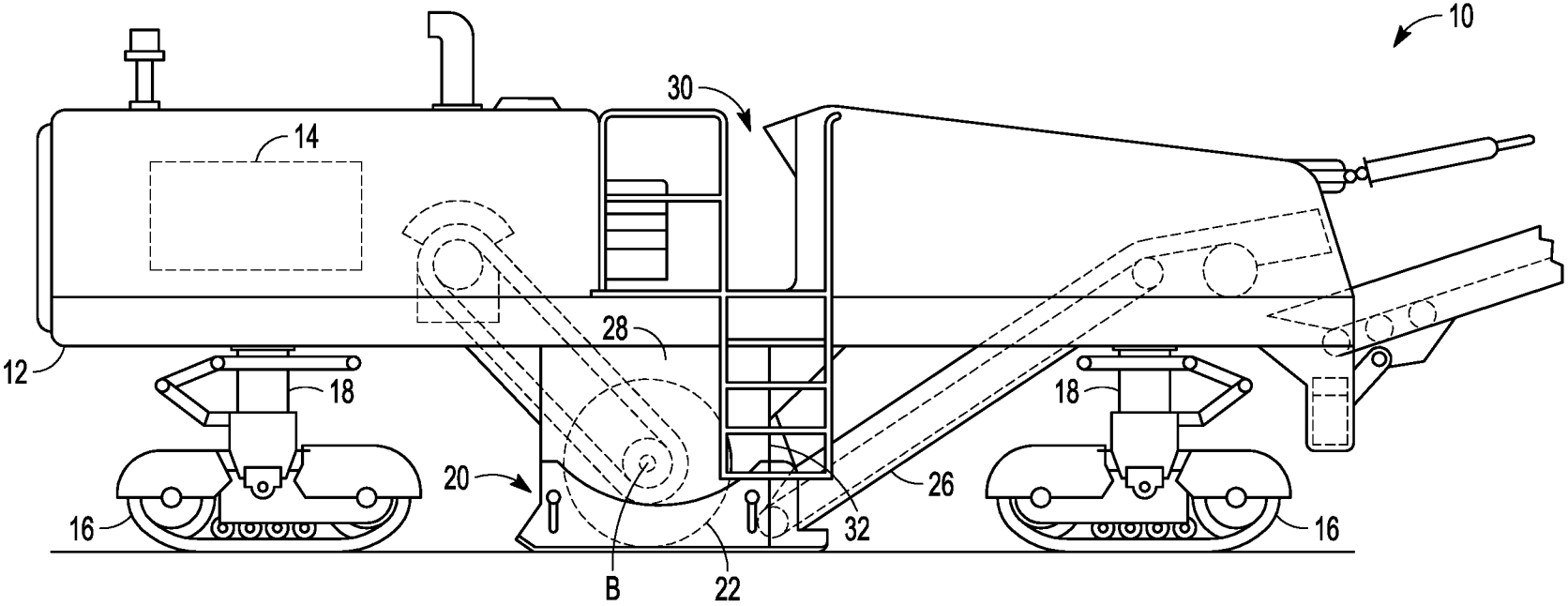
FIG. 1 shows a side view of a cold planer, in accordance with one embodiment.

FIG. 1 shows a side view of a cold planer 10, in accordance with one embodiment. The cold planer 10 includes a frame 12, and a power source 14 connected to the frame 12. The power source 14 may be provided in any number of different forms including, but not limited to, Otto and Diesel cycle internal combustion engines, electric motors, hybrid engines and the like.

The frame 12 is supported by transportation devices 16 via lifting columns 18. The transportation devices 16 may be any kind of ground-engaging device that allows to move the cold planer 10 in a forward direction over a ground surface, for example a paved road or a ground already processed by the cold planer 10. For example, in the shown embodiment, the transportation devices 16 are configured as track assemblies. The lifting columns 18 are configured to raise and lower the frame 12 relative to the transportation devices and the ground.

The cold planer 10 further includes a milling assembly 20 connected to the frame 12. The milling assembly 20 includes a drum housing 28 holding a rotatable cutting rotor 22 operatively connected to the power source 14. The cutting rotor 22 can be rotated about a drum or housing axis B extending in a direction perpendicular to the frame axis. As the rotatable cutting rotor 22 spins about its drum axis B, cutting bits on the cutting rotor 22 can engage hardened materials, such as, for example, asphalt and concrete, of existing roadways, bridges, parking lots and the like. As the cutting bits engage such hardened materials, the cutting bits remove layers of these hardened materials. The spinning action of the rotatable drum 22 and its cutting bits then transfers the hardened materials to a first stage conveyor 26 via a discharge port 32 on the drum housing 28. The first stage conveyor 26 can be coupled to the frame 12 and located at or near the discharge port 32.

The drum housing 28 includes front and rear walls, and atop cover positioned above the cutting rotor 22. Furthermore, the drum housing 28 includes lateral covers on the left and right sides of the cutting rotor 22 with respect to a travel direction of the cold planer 10. The drum housing 28 is open toward the ground so that the cutting rotor 22 can engage in the ground from the drum housing 28. The drum housing includes the discharge port 32 in a front wall to discharge material to the first stage conveyor 26, which is located at or near the discharge port 32.

The cold planer 10 further includes an operator station or platform 30 including an operator interface for inputting commands to a control system for controlling the cold planer 10, and for outputting information related to an operation of the cold planer 10.

Figure 2:
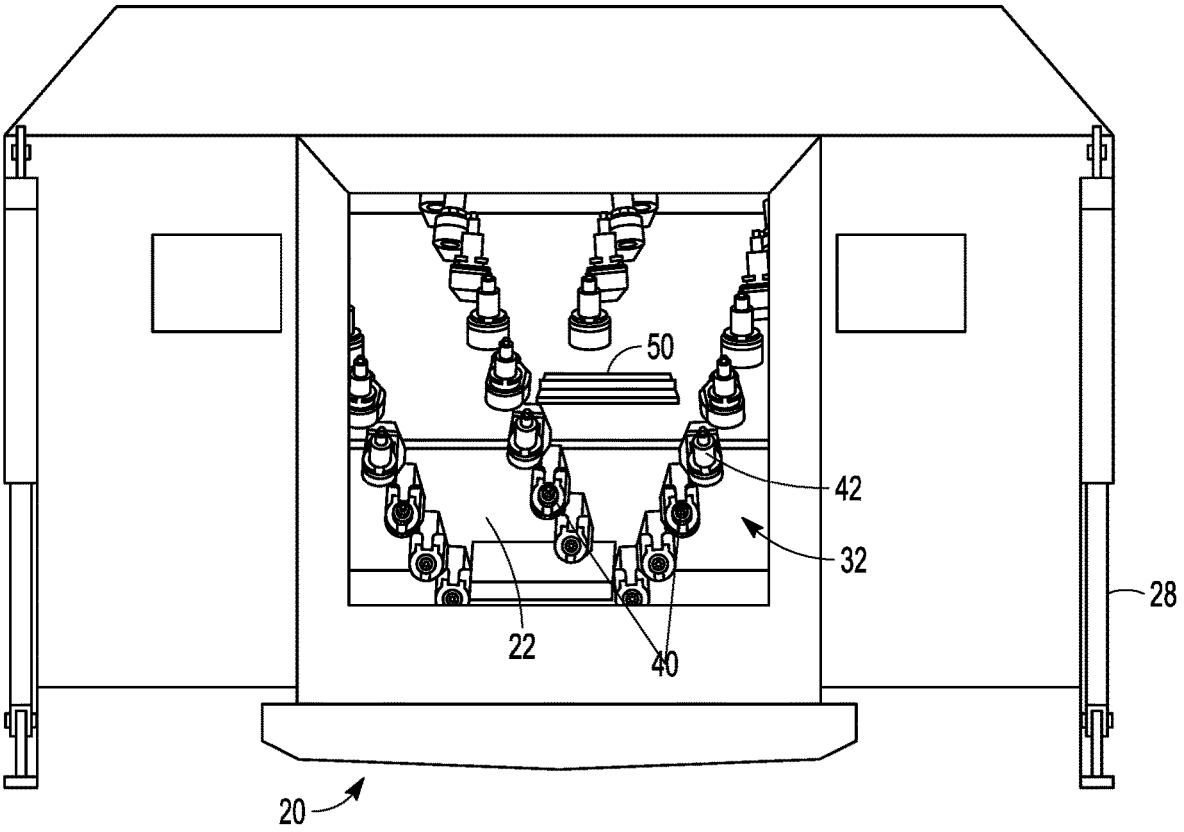
FIG. 2 shows a perspective view of a milling assembly, in accordance with one embodiment.

FIG. 2 shows a perspective view of the milling assembly 20, in accordance with one embodiment. In this example, the cutting rotor 22 is located within the drum housing 28. The cutting rotor includes a plurality of cutting bits 40 positioned around an outer surface 42 of the cutting rotor. The cutting rotor 22 further can include a plurality of paddles 50 located in a central area of the cutting rotor 22. The paddles 50 act as a discharge aid to move material towards the discharge port 32 and thus, the first stage conveyor.

However, due to geometry constraints in deeper cuts, the front wall of the drum housing 28 progressively blocks the paddles 50 from ejecting material at the optimum time. This can result in a material flow that is near vertical out of the chamber. The most efficient flow would be in line with the first stage conveyor. As will be discussed in detail below, the present system provides a flow director located at the top of the drum housing 28 near the discharge port 32 to redirect milled material onto the first stage conveyor.

Figure 3:
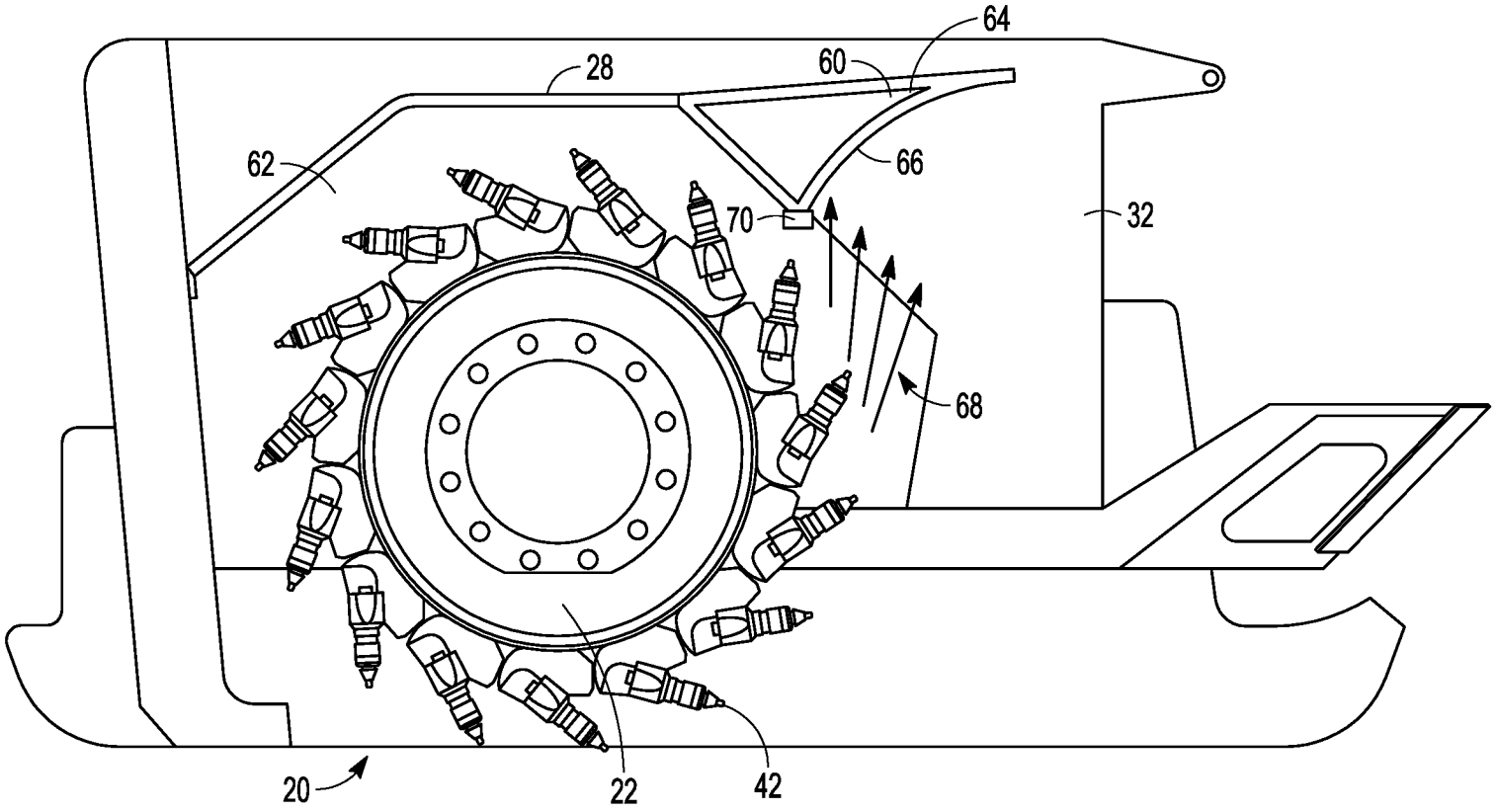
FIG. 3 shows a cross-section of a milling assembly, in accordance with one embodiment.

For example, FIG. 3 shows a side-view cross-section of the milling assembly 20, in accordance with one embodiment. In this example, the drum housing 28 includes a flow director 60 to direct a flow of material 68 removed by the cutting rotor 22 through the discharge port 32 and towards the first stage conveyor 26 (FIG. 1). The flow director 60 can be positioned within the drum housing 28 in an upper portion 62 of the drum housing 28 proximate the discharge port 32 and can be configured to redirect the flow of material 68 removed by the cutting rotor 22 so that instead of being nearly vertical, the flow of material 68 will be more in line with the first stage conveyor.

In one example, the flow director 60 is generally at a higher level than the cutting rotor 22 so as to redirect the material 68 in a generally more horizontal direction than the material's original upward direction. Thus, the material 68 goes upward from the cutting rotor 22 and is redirected to a lower angle to better align with the first stage conveyer as the material exits the discharge port 32.

In this example, the flow director 60 includes a chute 64 positioned at the upper portion 62 of the drum housing 28. The chute 64 can include an angled or curved deflection surface 66 positioned so as to direct flow of material 68 towards the discharge port 32. The angled or curved deflection surface 66 can be configured such that the material 68 hits the deflection surface 66 and is redirected towards the discharge port 32, and thus, towards the first stage conveyor 26.

In one example, the chute 64 can include a lower edge surface 70 positioned proximate the outer surface 42 of the cutting rotor 22 to prevent material 68 from traveling around the cutting rotor 22. Thus, the lower edge surface 70 acts a breaker bar.

In this example, the chute 64 redirects the material 68 in an efficient manner without wasting much energy slowing it down. In various examples, the chute 64 can be engineered at the optimum angle and curvature to provide efficient flow at all depths of cut.

Figure 4:
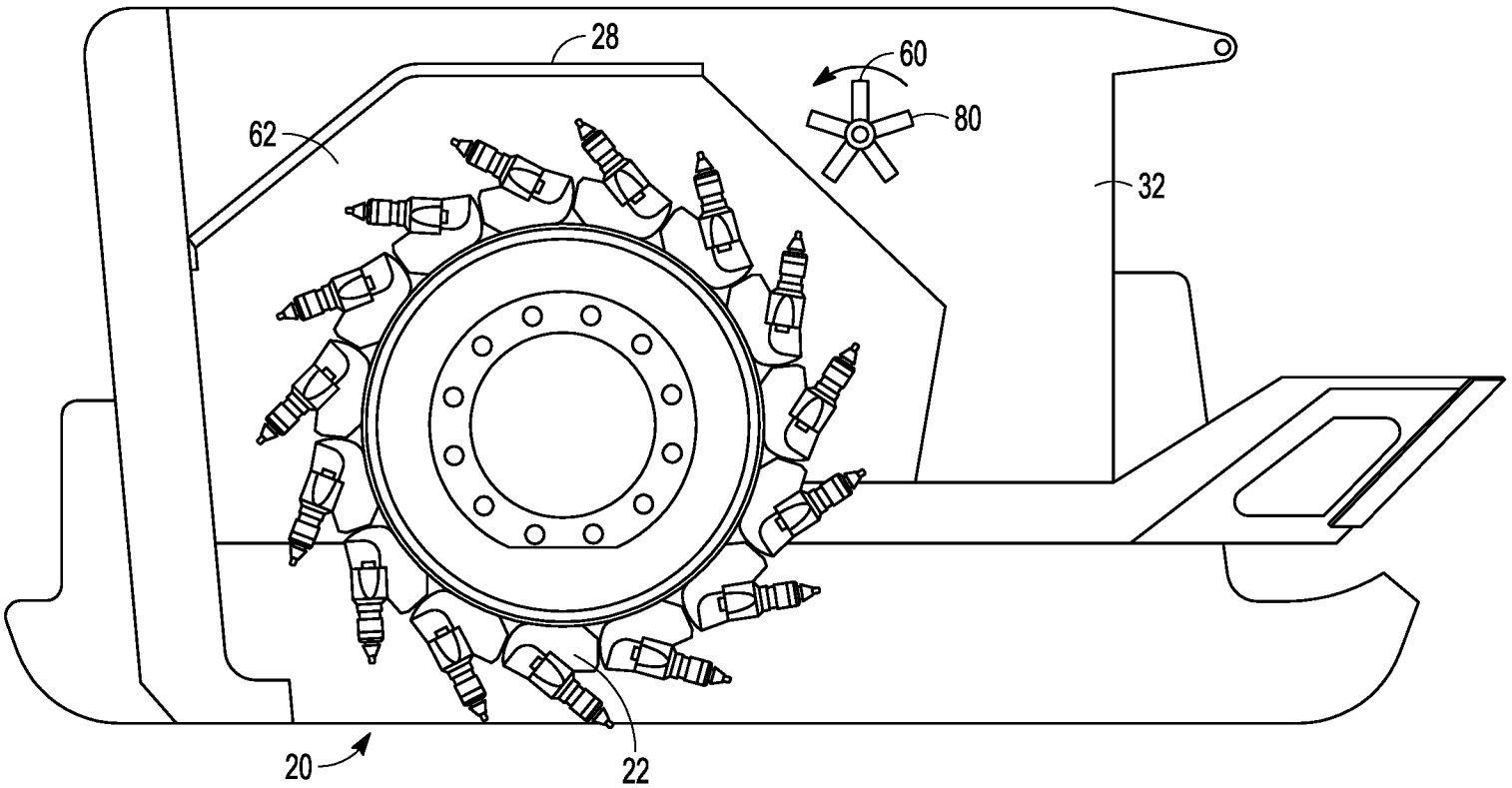
FIG. 4 shows a cross-section of a milling assembly, in accordance with one embodiment.

FIG. 4 shows a side view cross-section of the milling assembly 20, in accordance with one embodiment. In this example, the flow director 60 can include a powered wheel 80 positioned in the upper portion 62 of the drum housing 28 proximate the discharge port 32 and rotating so as to direct material 68 towards the discharge port 32. For example, the powered wheel 80 can be spun in the opposite direction relative to the cutting rotor 22 so as to redirect the material towards the discharge port 32 in line with the first stage conveyor.

The powered wheel 80 can be designed to have various rotational speeds. In one example, the powered wheel 80 can be configured to rotate at approximately the same rotation speed as the cutting rotor 22.

INDUSTRIAL APPLICABILITY

The present system is applicable to a milling assembly for a cold planer. In these applications various ground or road conditions are encountered and various depths of cut are desired.

Figure 5:
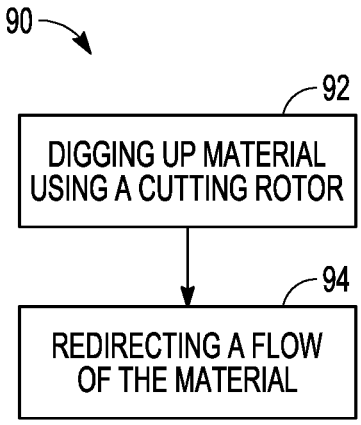
FIG. 5 shows a flowchart of a method of controlling material flow in a cold planer, in accordance with one embodiment.

FIG. 5 shows a flow chart of a method 90 of controlling material flow in a cold planer, in accordance with one embodiment. The method will be described using the features of FIGS. 1-4, as discussed above.

Here the method 90 can include digging up material (92) from a roadbed using a cutting rotor 22, the cutting rotor 22 being located within a drum housing 28 having a discharge port 32. As the cutting rotor 22 rotates, the removed material may flow in a generally upward direction. The method 90 further includes redirecting the flow of the material (94) removed by the cutting rotor 22 towards a first stage conveyor 26 positioned near the discharge port 32.

In one example method, redirecting the flow can be accomplished with a flow director 60 including a chute 64 positioned at an upper portion of the drum housing 28. The chute 64 can include an angled or curved deflection surface 66 positioned so as to direct the flow of material towards the discharge port 32 and more in line with the first stage conveyor.

In another example method, redirecting the flow can be accomplished with a flow director 60 including a powered wheel 80 positioned in the upper portion of the drum housing 28 proximate the discharge port and rotating so as to direct material towards the discharge port 32.

By redirecting the material flow as discussed above, the present system allows for an improvement over prior machines. For example, such redirection of the material flow provides better machine efficiency, better productivity, better fuel consumption, and less wear and tear on the rotor and drum housing.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. A milling assembly comprising:

a drum housing including a discharge port;

a cutting rotor located within the drum housing; and a flow director positioned within the drum housing proximate the discharge port, the flow director including a deflection surface that is inclined non-perpendicularly relative to the discharge port so as to be at least partially facing the discharge opening, wherein the deflection surface is positioned relative to the cutting rotor such that the deflection surface of the flow director re-directs a relatively vertical flow of material coming off the cutting rotor to a relatively horizontal flow orientation perpendicular to a rotational axis of the cutting rotor such that the flow director being configured to direct the flow of material removed by the cutting rotor towards a first stage conveyor positioned near the discharge port.

2. The milling assembly of claim 1, wherein the flow director is located in an upper portion of the drum housing.

3. The milling assembly of claim 2, wherein the flow director is configured to direct the flow of material to be approximately in line with the first stage conveyor.

4. The milling assembly of claim 2, wherein the flow director includes a chute positioned at the upper portion of the drum housing.

5. The milling assembly of claim 4, wherein the chute includes an angled or curved deflection surface positioned so as to direct the flow of material towards the discharge port.

6. The milling assembly claim 5, wherein the angled or curved deflection surface is configured such that the material hits the deflection surface and is redirected towards the discharge port.

7. The milling assembly of claim 4, wherein the chute includes a lower edge surface positioned proximate an outer surface of the cutting rotor to prevent material from traveling around the cutting rotor.

8. The milling assembly of claim 2, wherein the flow director includes a powered wheel positioned in the upper portion of the drum housing proximate the discharge port and rotating so as to direct material towards the discharge port.

9. The milling assembly of claim 8, wherein the powered wheel is configured to rotate at approximately the same rotation speed as the cutting rotor.

10. The milling assembly of claim 1, wherein the cutting rotor includes cutting bits around an outer surface and paddles in a central area of the cutting rotor.

11. A cold planer comprising:

a frame;

a first stage conveyor coupled to the frame;

a milling assembly including a drum housing, the drum housing including a discharge port, wherein the first stage conveyor is positioned near the discharge port so as to receive material through the discharge port; and a cutting rotor located within the drum housing;

wherein, the drum housing includes a flow director, the flow director including a deflection surface that is inclined non-perpendicularly relative to the discharge port so as to be at least partially facing the discharge opening, wherein the deflection surface is positioned relative to the cutting rotor such that the deflection surface of the flow director re-directs a relatively vertical flow of material coming off the cutting rotor to a relatively horizontal flow orientation perpendicular to a rotational axis of the cutting rotor so as to direct the flow of material removed by the cutting rotor towards the first stage conveyor.

12. The cold planer of claim 11, wherein the flow director is located in an upper portion of the drum housing.

13. The cold planer of claim 12, wherein the flow director includes a chute positioned at the upper portion of the drum housing.

14. The cold planer of claim 13, wherein the chute includes an angled or curved deflection surface positioned so as to direct flow of material towards the discharge port.

15. The cold planer of claim 14, wherein the angled or curved deflection surface is configured such that the material hits the deflection surface and is redirected towards the discharge port.

16. The cold planer of claim 13, wherein the chute includes a lower edge surface positioned proximate an outer surface of the cutting rotor to prevent material from traveling around the cutting rotor.

17. The cold planer of claim 11, wherein the flow director includes a powered wheel positioned in the upper portion of the drum housing proximate the discharge port and rotating so as to direct material towards the discharge port.

18. A method of controlling material flow in a cold planer, the method comprising:

digging up material from a roadbed using a cutting rotor, the cutting rotor located within a drum housing having a discharge port; and redirecting a flow of the material removed by the cutting rotor towards a first stage conveyor positioned near the discharge port, when redirecting the flow is accomplished by a flow director, the flow director including a deflection surface that is inclined non-perpendicularly relative to the discharge port so as to be at least partially facing the discharge opening, wherein the deflection surface is positioned relative to the cutting rotor such that the deflection surface of the flow director re-directs a relatively vertical flow of material coming off the cutting rotor to a relatively horizontal flow orientation perpendicular to a rotational axis of the cutting rotor.

19. The method of controlling material flow of claim 18, wherein redirecting the flow of the material includes positioning a chute in an upper portion of the drum housing, wherein the chute includes an angled or curved deflection surface positioned so as to direct the flow of material towards the discharge port.

20. The method of controlling material flow of claim 18, wherein redirecting the flow of the material includes positioning a powered wheel in an upper portion of the drum housing proximate the discharge port and rotating the powered wheel so as to direct the flow of material towards the discharge port.

* * * * *